US009089964B2

(12) United States Patent
Cheng

(10) Patent No.: US 9,089,964 B2
(45) Date of Patent: Jul. 28, 2015

(54) TOOL BOX

(71) Applicant: Chin-Shun Cheng, Taichung (TW)

(72) Inventor: Chin-Shun Cheng, Taichung (TW)

( * ) Notice: Subject to any disclaimer, the term of this patent is extended or adjusted under 35 U.S.C. 154(b) by 77 days.

(21) Appl. No.: 13/943,811

(22) Filed: Jul. 17, 2013

(65) Prior Publication Data

US 2015/0021220 A1 Jan. 22, 2015

(51) Int. Cl.
*B25H 3/02* (2006.01)
*B25H 3/00* (2006.01)

(52) U.S. Cl.
CPC . *B25H 3/02* (2013.01); *B25H 3/006* (2013.01)

(58) Field of Classification Search
CPC ..... B25H 3/02; B25H 3/006
USPC ..... 206/349, 372, 373; 220/62, 683; 312/140, 258, 263, 265.5, 902; 403/363, 382, 401, 403
See application file for complete search history.

(56) References Cited

U.S. PATENT DOCUMENTS

| | | | | | |
|---|---|---|---|---|---|
| 2,155,128 | A * | 4/1939 | Gray | 220/62 |
| 3,266,656 | A * | 8/1966 | Kridle | 220/4.28 |
| 4,278,196 | A * | 7/1981 | Ford | 220/62 |
| 4,621,879 | A * | 11/1986 | Schneider | 312/258 |
| 5,000,301 | A * | 3/1991 | Grenier | 190/127 |
| 6,682,256 | B1 * | 1/2004 | Hor | 403/382 |
| 8,245,467 | B2 * | 8/2012 | Lewis et al. | 52/282.3 |
| 2005/0000836 | A1 * | 1/2005 | Hsien | 206/349 |
| 2006/0201833 | A1 * | 9/2006 | Chen | 206/349 |
| 2011/0036735 | A1 * | 2/2011 | Cho | 206/349 |

* cited by examiner

*Primary Examiner* — Luan K Bui

(57) ABSTRACT

A tool box includes at least one body which has a metal plate with multiple sides. Each side of the metal plate is bent to form a side wall so as to form a space between the metal plate and the side walls. Each corner of the metal plate has a notch and the side walls each have a distal section located corresponding to the notch. Each distal section has a first connection portion. Multiple connection members each have two wings extending from a bottom plate. Each wing has a slot and a second connection portion. The two distal sections of the two side walls are inserted into the two respective slots of the connection member, and the bottom plate closes the notch. The first connection portion is engaged with the second connection portion corresponding thereto.

4 Claims, 10 Drawing Sheets

TOOL BOX

FIELD OF THE INVENTION

The present invention relates to a tool box, and more particularly, to a tool box made by metal plate which is bent to have multiple sidewalls, and each corner of the tool box is reinforced by a connection member.

BACKGROUND OF THE INVENTION

The conventional tool boxes are made by plastic and one of which is disclosed in FIG. 16 and generally comprises a bottom part 71 and a top part 72. The bottom part 71 has a space for receiving tools and a bottom locking part 711 is formed to the front side of the bottom part 71. A bottom pivotal member is formed to the rear side of the bottom part 71. The top part 72 has a top locking part 721 which is to be engaged with the bottom locking part 711 when the top part 72 is locked to the bottom part 71. A top pivotal member is formed to the rear side of the top part 72 so as to be pivotably connected with the bottom pivotal member of the bottom part 71. The advantages of the plastic tool box are that the bottom pivotal member and the bottom locking part 711 are formed to the bottom part 71 integrally, and the top pivotal member and the top locking part 721 are formed to the top part 72 integrally. In other words, there are only two main parts 71, 72 to be manufactured so that the manufacturing cost is reduced, and there are multiple colors to be chosen from for the tool box. However, the plastic bottom part 71 and the top part 72 are weak in structural strength.

FIG. 17 shows a metal tool box which comprises a bottom part 61 and a top part 62. The bottom part 61 has a space for receiving tools and a bottom locking part 63 is connected to the front side of the bottom part 61. A bottom pivotal member is connected to the rear side of the bottom part 61. The top part 62 has a top locking part 64 which is to be engaged with the bottom locking part 63 when the top part 62 is locked to the bottom part 61. A top pivotal member is connected to the rear side of the top part 62 so as to be pivotably connected with the bottom pivotal member of the bottom part 61. The advantages of the metal tool box are that structural strength is better than the plastic tool box. However, the bottom pivotal member and the bottom locking part 63 are individually connected to the bottom part 61, and the top pivotal member and the top locking part 64 are individually connected to the top part 72. The top part 62 has to form a recess for the handle. In other words, there are multiple parts needed to be installed to the bottom and top parts 62, 61 such that the time for assembling the metal tool box is longer than that of the plastic tool box.

The present invention intends to provide a metal tool box for improving the shortcomings of the conventional tool boxes.

SUMMARY OF THE INVENTION

The present invention relates to a tool box and comprises at least one body which has a metal plate with multiple sides. Each side of the metal plate is bent to form a side wall so as to form a space between the metal plate and the side walls. Each corner of the metal plate has a notch and the side walls each have a distal section located corresponding to the notch. Each distal section has a first connection portion. Multiple connection members each have two wings extending from a bottom plate. Each wing has a slot and a second connection portion. The two distal sections of the two side walls are inserted into the two respective slots of the connection member, and the bottom plate closes the notch. The first connection portion is engaged with the second connection portion corresponding thereto.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
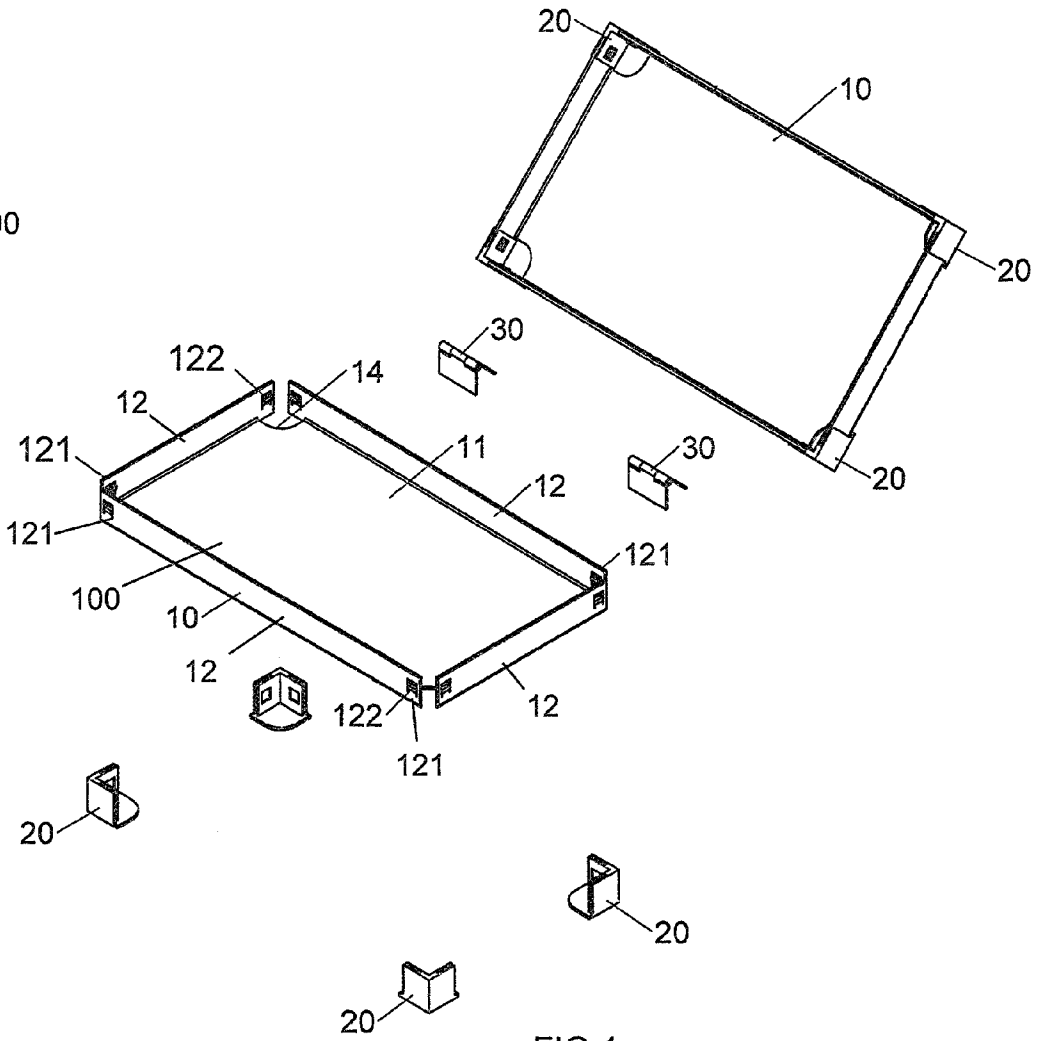
FIG. 1 is an exploded view to show the tool box of the present invention.
Figure 2:
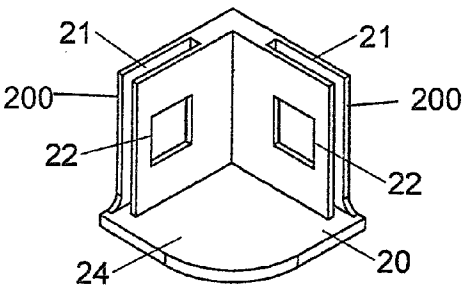
FIG. 2 is a perspective view to show the connection member of the present invention.
Figure 3:
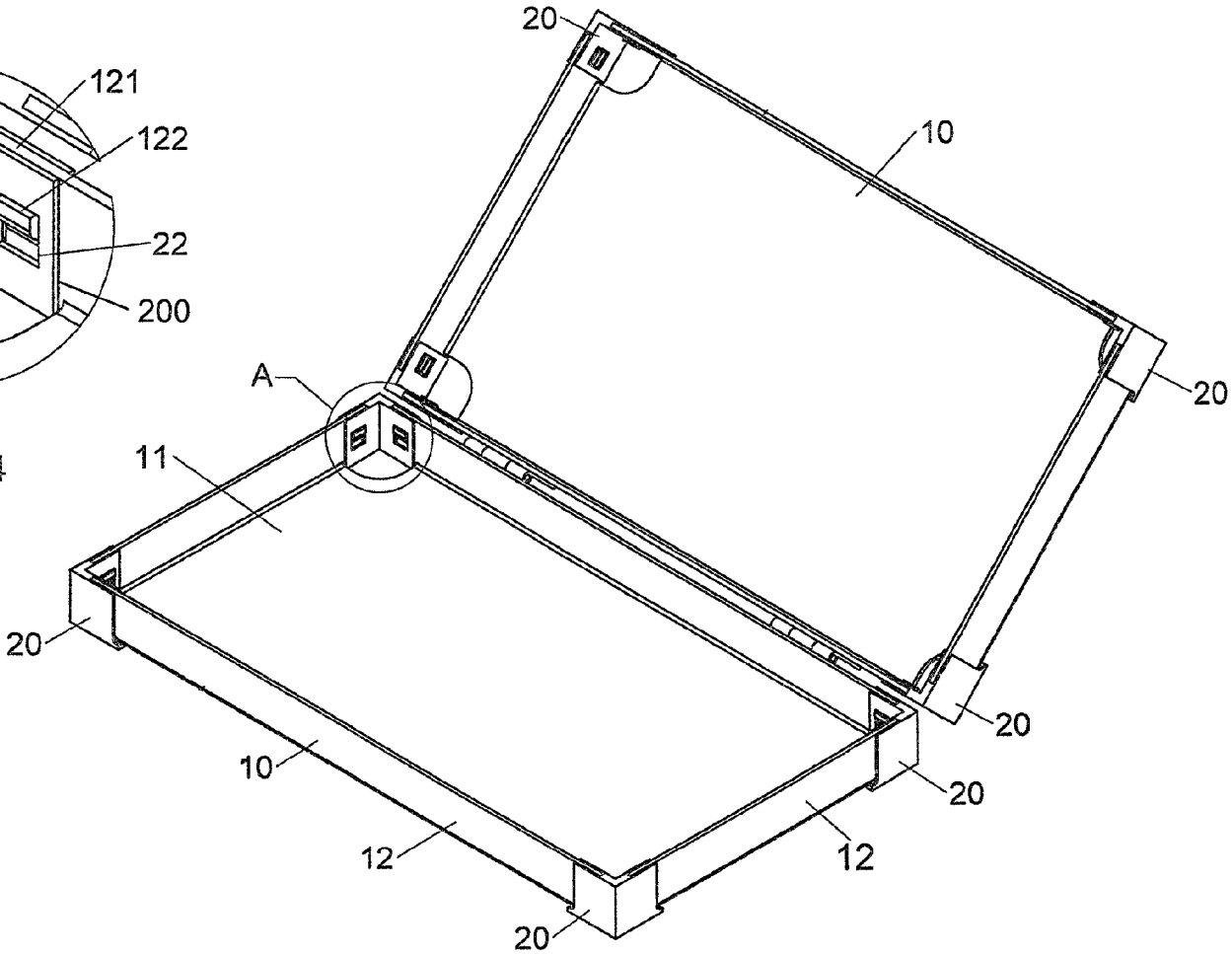
FIG. 3 is a perspective view to show the tool box of the present invention.
Figure 4:
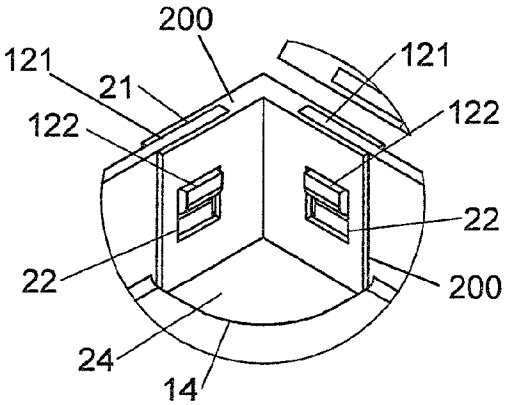
FIG. 4 is an enlarged view of the circle "A" in FIG. 3.
Figure 7:
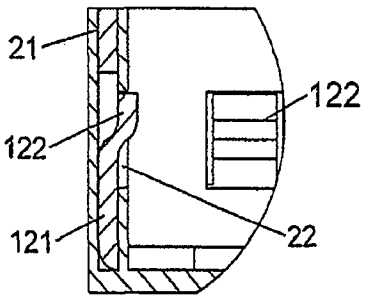
FIG. 7 is an enlarged view of the circle "C" in FIG. 6.
Figure 6:
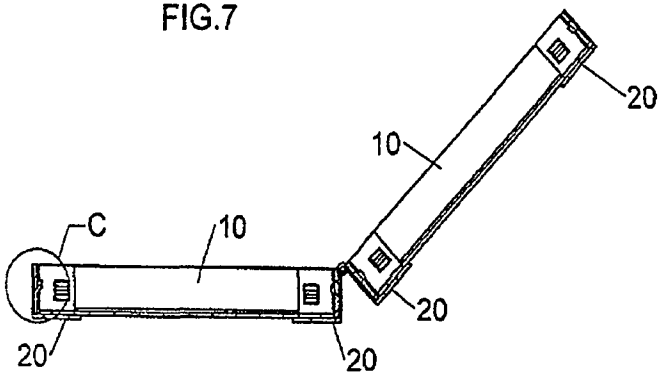
FIG. 6 is a cross sectional view, taken along line 6-6 in FIG. 5.
Figure 5:
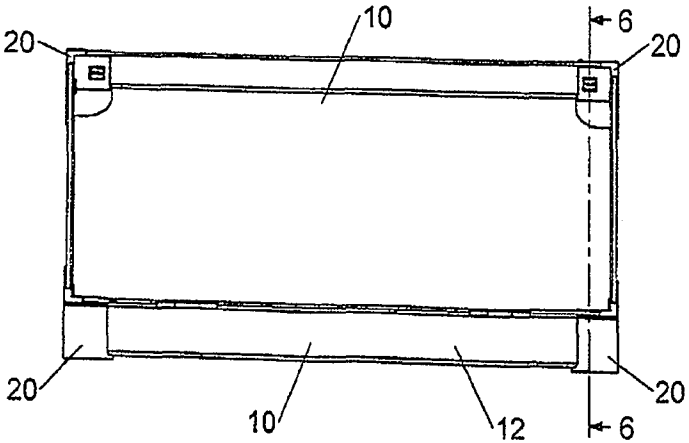
FIG. 5 is a front view of the tool box of the present invention.

Referring to FIGS. 1 to 7, the tool box of the present invention comprises at least one body 10 and multiple connection members 20. The at least one body 10 has a metal plate 100 which has multiple sides, in this embodiment, the metal plate 100 is a rectangular plate. Each side of the metal plate 100 is bent to form a side wall 12, and a space 11 defined between the metal plate 100 and the side walls 12. Each corner of the metal plate 100 has a notch 14 so that the side walls 12 each have a distal section 121 located corresponding to the notch 14. Each distal section 121 has a first connection portion 122. Each of the first connection portions 122 is a protrusion which extends from a face of the side wall 12 and has a free and flexible distal end. The connection members 20 are made by plastic, rubber, non-metal material or carbon fibers.

Each of the multiple connection members 20 has two wings 200 extending from a bottom plate 24. The two wings 200 are perpendicularly connected at two respective ends thereof. Each wing 200 has a slot 21 defined in the other end thereof and a second connection portion 22 is defined in the wing 200. The second connection portion 22 is a hole and communicates with the slot 21. The two distal sections 121 of the two side walls 12 are inserted into the two respective slots 21 of the connection members 20. The bottom plate 24 closes the notch 14. The first connection portion 122 is engaged with the second connection portion 22 corresponding thereto, so that each of the connection members 20 is connected the two side walls 12 located corresponding to the two wings 200 thereof to reinforce the strength of the corners of the tool box. In the embodiment, there are two bodies 10 which are connected to each other by using two pivotal members 30.

Figure 8:
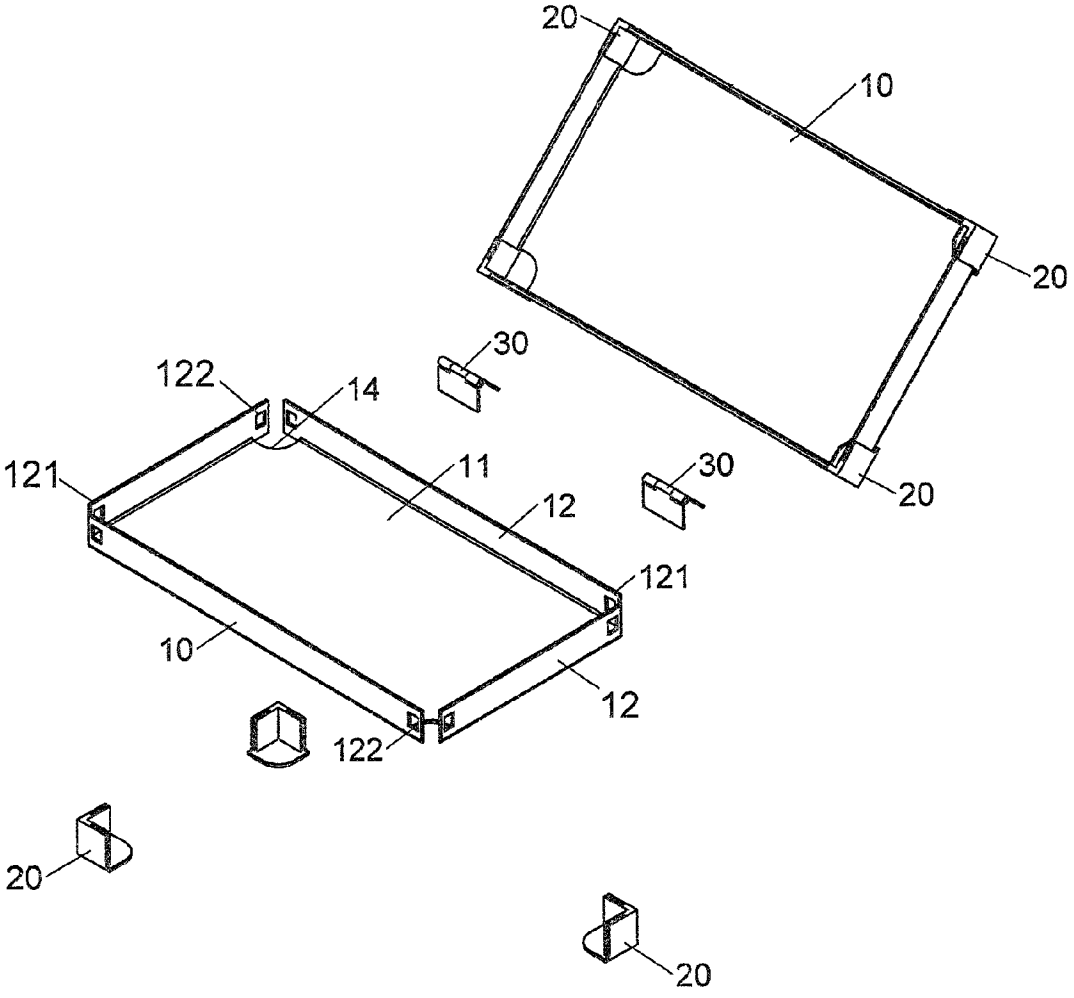
FIG. 8 is an exploded view to show the second embodiment of the tool box of the present invention.
Figure 9:
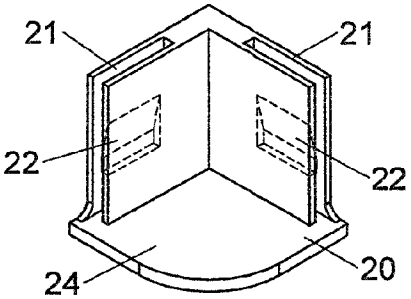
FIG. 9 is a perspective view to show the connection member of the second embodiment of the tool box of the present invention.
Figure 10:
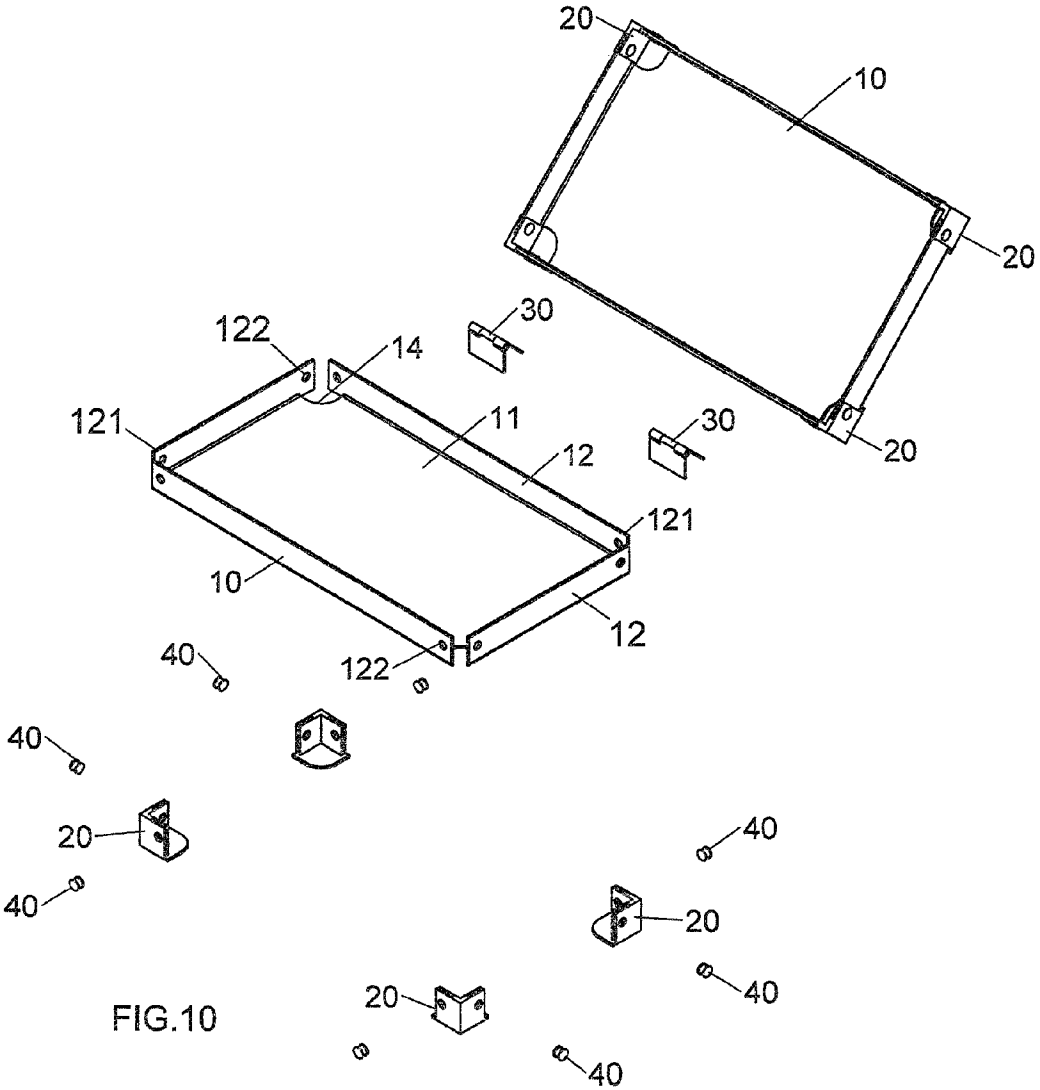
FIG. 10 is an exploded view to show the third embodiment of the tool box of the present invention.
Figure 11:
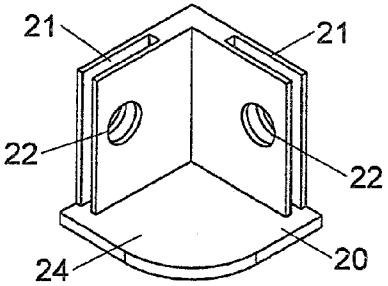
FIG. 11 is a perspective view to show the connection member of the third embodiment of the tool box of the present invention.
Figure 12:
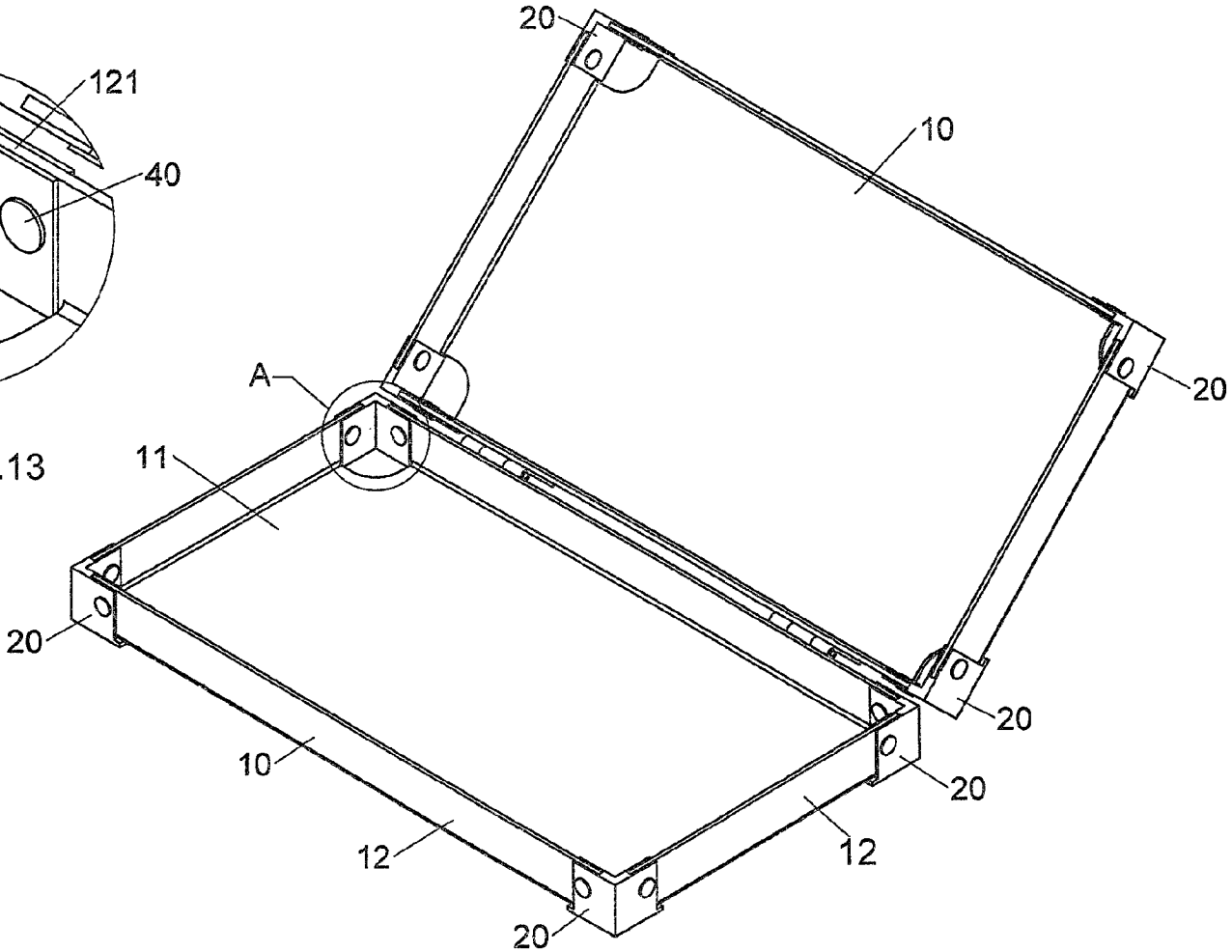
FIG. 12 is a perspective view to show the third embodiment of the tool box of the present invention.
Figure 13:
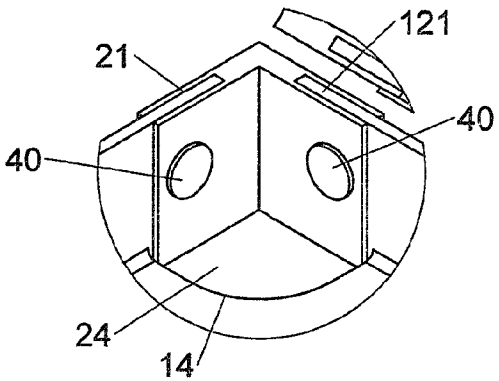
FIG. 13 is an enlarged view of the circle "A" in FIG. 12.

As shown in FIGS. 8 and 9, each of the first connection portions 122 is a hole and each of the second connection portions 22 is a protrusion which extends from a face of the wing 200 and has a free and flexible distal end. The first connection portions 122 are engaged with the second connection portions 22 respectively.

As shown in FIGS. 10 to 13, each of the first and second connection portions 122, 22 is a hole. A connection piece extends through the two holes of the first and second connection portions 122, 22 to connect the first and second connection portions 122, 22.

Figure 14:
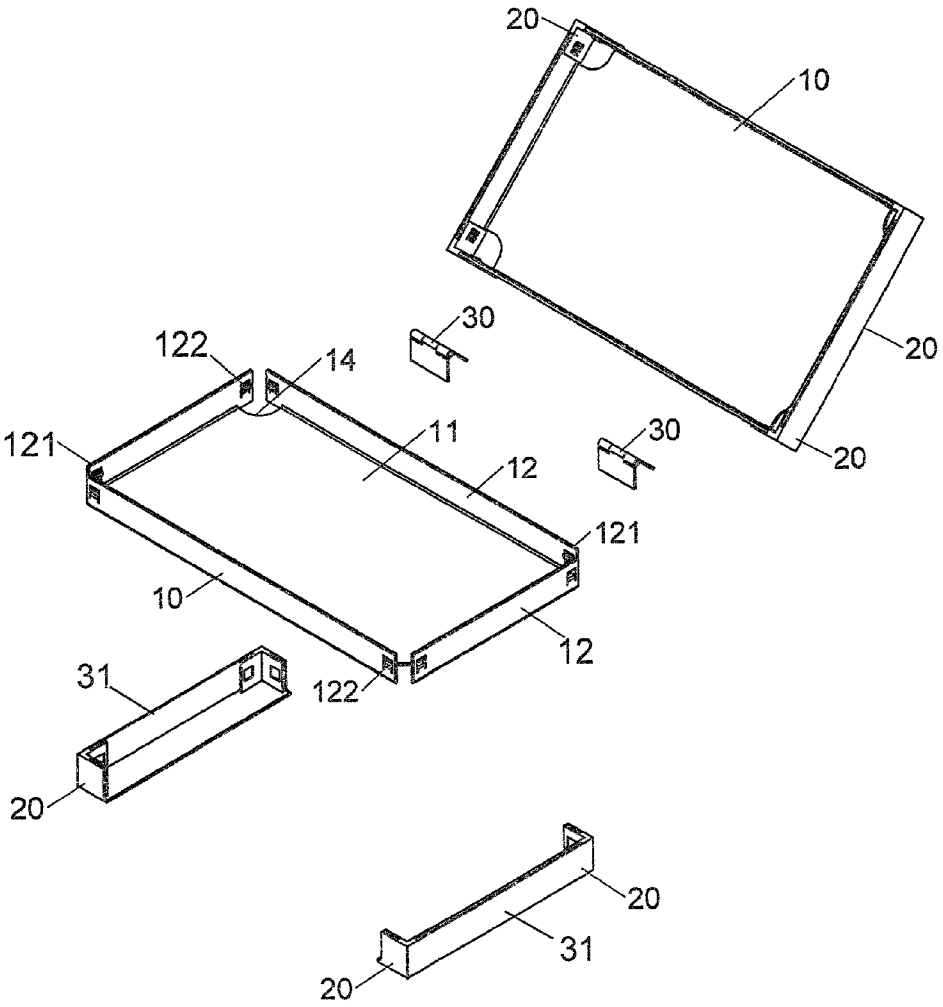
FIG. 14 is an exploded view to show the fourth embodiment of the tool box of the present invention.

As shown in FIG. 14, in this embodiment, the plate 100 is a rectangular plate having two long sides and two short sides. There are four connection members 20. The two connection members 20 on two ends of each of the short sides are connected by a connection part 31.

Figure 15:
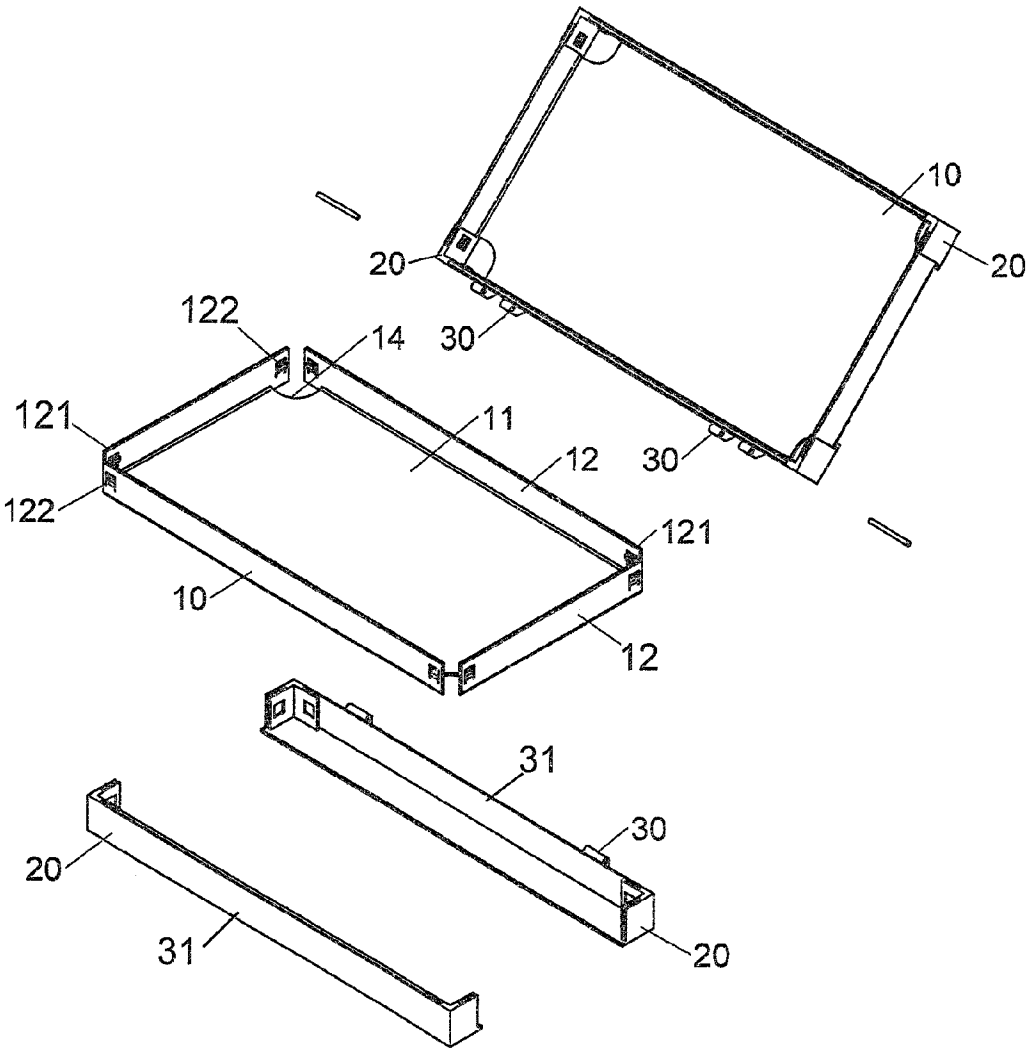
FIG. 15 is an exploded view to show the fifth embodiment of the tool box of the present invention.
Figure 16:
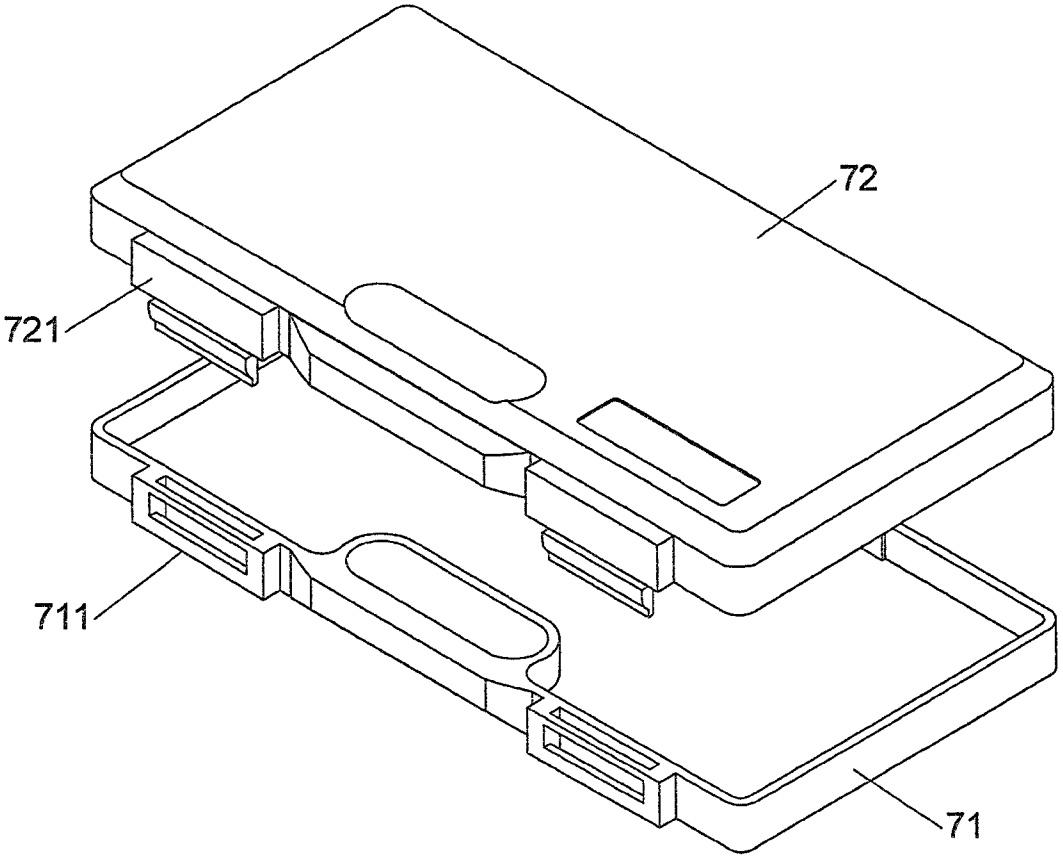
PRIOR ART FIG.16
FIG. 16 shows the conventional plastic tool box.
Figure 17:
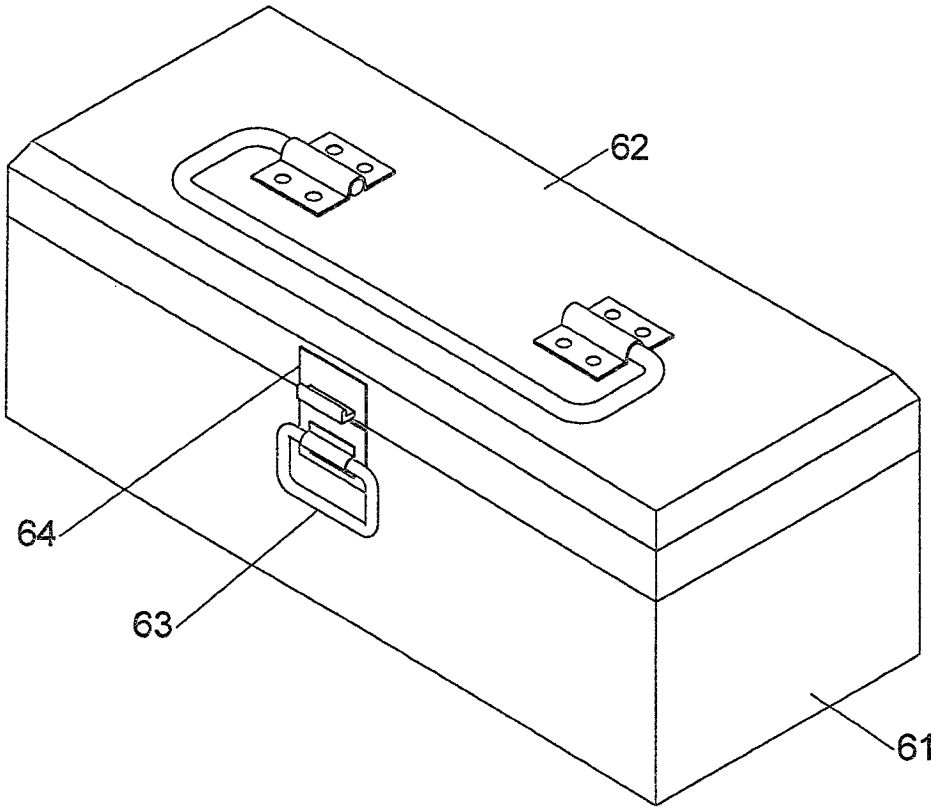
PRIOR ART FIG. 17
FIG. 17 shows the conventional metal tool box.

As shown in FIG. 15, in this embodiment, the plate 100 is a rectangular plate having two long sides and two short sides. There are four connection members 20. The two connection members 20 on two ends of each of the long sides are connected by a connection part 31. There are two bodies 10 and the connection parts 31 on one side of the tool box are pivotably connected to each other by at least one pivotal member 30.

The body 10 is made by the metal plate 100 which forms four side walls, and the connection members 20 are connected to the corners to reinforce the strength of the body 10. The tool box is easily assembled and manufactured.

The side walls 12 of the metal plate 100 are integrally formed so as to be connected with the connection members 20. The tool box is made at lower cost.

The distal sections 121 of the side walls 12 are inserted into the slots 21 of the connection members 20, and the first and second connection portions 122, 22 are connected to each other, these connections are easy and convenient when assembling the tool box.

The metal plate 100 is first punched to form the notches 14 on the corners, and the side walls 12 are bent along the sides of the metal plate 100. The connection members 20 are then easily connected to the corners to assemble the tool box easily.

The connection members 20 are made by plastic which has different colors to be chosen from, the connection members 20 are located at the corners of the tool box to make the tool box have attractive appearance.

While we have shown and described the embodiment in accordance with the present invention, it should be clear to those skilled in the art that further embodiments may be made without departing from the scope of the present invention.

What is claimed is:

1. A tool box comprising:

at least one body having a rectangular metal plate which has two long sides and two short sides, each side of the metal plate being bent to form a side wall, a space defined between the metal plate and the side walls, each corner of the metal plate having a notch so that the side walls each having a distal section located corresponding to the notch, each distal section having a first connection portion, the first connection portions being a protrusion which extends from a face of the side wall and having a free and flexible distal end, and four connection members each having two wings extending from a bottom plate, the two wings being perpendicularly connected at two respective ends thereof, each wing having a slot and a second connection portion, the second connection portions being a hole, two distal sections of two side walls being inserted into the two respective slots of the connection members, the bottom plate closing the notch, the protrusion engaged with the hole corresponding thereto, and the two connection members on two ends of each of the long sides being connected by a connection part.

2. The tool box as claimed in claim 1, wherein there are two bodies which are pivotably connected to each other.

3. A tool box comprising:

at least one body having a rectangular metal plate which has two long sides and two short sides, each side of the metal plate being bent to form a side wall, a space defined between the metal plate and the side walls, each corner of the metal plate having a notch so that the side walls each having a distal section located corresponding to the notch, each distal section having a first connection portion, the first connection portions being a protrusion which extends from a face of the side wall and having a free and flexible distal end, and four connection members each having two wings extending from a bottom plate, the two wings being perpendicularly connected at two respective ends thereof, each wing having a slot and a second connection portion, the second connection portions being a hole, two distal sections of two side walls being inserted into the two respective slots of the connection members, the bottom plate closing the notch, the protrusion engaged with the hole corresponding thereto, and the two connection members on two ends of each of the short sides being connected by a connection part.

4. The tool box as claimed in claim 3, wherein there are two bodies and the connection parts on one side of the two bodies are pivotably connected to each other by at least one pivotal member.

* * * * *